United States Patent [19]

Kondo et al.

[11] Patent Number: 4,460,852

[45] Date of Patent: Jul. 17, 1984

[54] METHOD OF CONTROLLING MILL MOTORS SPEEDS IN A COLD TANDEM MILL

[75] Inventors: Katsuya Kondo, Amagasaki; Shigeru Tajima, Wakayama, both of Japan

[73] Assignee: Sumitomo Kinzoku Kogyo Kabushiki Gaisha, Osaka, Japan

[21] Appl. No.: 344,058

[22] Filed: Jan. 29, 1982

[30] Foreign Application Priority Data

Feb. 6, 1981 [JP] Japan ..... 56-17288

[51] Int. Cl.[3] ..... B21B 37/00

[52] U.S. Cl. ..... 318/67; 318/69; 72/8

[58] Field of Search ..... 318/311–312, 318/67–75, 314–315, 317, 318, 326–329, 333, 392, 395–398, 449–450, 404, 452–455, 463–464, 475–476, 478; 364/472; 72/6, 8, 11, 19, 199, 212, 213

[56] References Cited

U.S. PATENT DOCUMENTS

| | | | |
|---|---|---|---|
| 3,387,470 | 9/1965 | Smith, Jr. | 364/472 |
| 3,657,623 | 4/1972 | Fludzinski | 318/326 |
| 3,892,112 | 7/1975 | Smith, Jr. | 72/11 |
| 4,090,118 | 5/1978 | Smith, Jr. | 318/396 |
| 4,137,742 | 2/1979 | Tanifuji et al. | 72/19 |
| 4,145,901 | 3/1979 | Imai et al. | 72/19 |
| 4,227,130 | 10/1980 | Safiuddin et al. | 318/327 |
| 4,292,825 | 10/1981 | Morooka et al. | 72/19 |

*Primary Examiner*—G. Z. Rubinson
*Assistant Examiner*—Arthur G. Evans
*Attorney, Agent, or Firm*—Burns, Doane, Swecker & Mathis

[57] ABSTRACT

This invention concerns a method of controlling mill-motor speed in a cold tandem mill. During unsteady phases of rolling operation such as threading, rolling speed acceleration and/or deceleration, and tail out with respect to the coil being rolled, mill motors are so controlled as not to perform drooping characteristic action except under certain specific conditions, and at threading phase in particular, motors in individual stands are so controlled as to revolve at a uniformly decreased speed, whereby final gauge control accuracy can be improved with respect to top and bottom end portions of the coil and such troubles as coil cut and the like can be effectively prevented.

6 Claims, 10 Drawing Figures

METHOD OF CONTROLLING MILL MOTORS SPEEDS IN A COLD TANDEM MILL

BACKGROUND OF THE INVENTION (1) Field of the Invention

The present invention relates to a method of controlling revolving speeds of mill motors in a cold tandem mill. More particularly, it relates to a method of controlling motor speeds which makes it possible to obtain the desired final gauge during rolling operation, whether operation is at steady speed or it is at non-steady speed as at threading stage.

(2) Description of the Prior Art

In the manufacture of cold-rolled steel sheets, gauge accuracy is the most important control item. For the purpose of achieving such accuracy, automatic gauge control or so-called AGC technique is employed in cold-tandem mill operation. Generally, rolling operation at a tandem mill may be divided into five stages according to rolling speed, namely, threading stage for inserting the top end of the stock or a hot-rolled coil into a stand of the mill, acceleration stage for increasing the rolling speed from low at threading stage up to steady high, steady-speed operation stage where rolling is carried out with respect to a greater proportion of the coil, deceleration stage for decreasing the rolling speed, and tail-out stage, where the bottom end of the coil is dethreaded from the mill at low rolling speed. Since a major part of the coil is rolled at steady operation speed, most of the conventional AGC methods are intended for gauge control during steady-speed rolling operation, there being almost none intended for use during lower-speed rolling operation. So far, no AGC method has been proposed which can be effectively employed for gauge control at such stages as threading, acceleration, deceleration, and/or tail-out. Conventionally, therefore, gauge control at threading, tail-out, acceleration and deceleration stages is performed manually while operation speed is lower than the speed at which AGC system is usually actuated (several to 20 percent of steady-operation speed). This often results in no small portion of the rolled sheet being rendered off-gauge or out of tolerance limits as to gauge. Such off-gauge portion, which is naturally discarded, means decreased yield, so an effective solution to this difficulty has been strongly desired.

In order to achieve production meeting the target gauge, speed setting is made, before threading operation, with respect to roll-driving mill motors according to the draft schedule. The problem here is that the target gauge sought by mill-motor speed setting before threading is not always attainable, because some control error often occurs as the top end of the coil is inserted between the rolls. Such error is due primarily to drooping characteristic control function incorporated into automatic speed control means for mill motor control. Said control means is designed to detect mill-motor speed and control it to the value according to the reference even in the event of any change being caused to the motor speed by load variation or other factor. Now, if such control function is strictly faithful to references, any erroneous setting of references may cause excessive tension to be applied to the coil at inter-stand portions thereof, with the result of coil break trouble, or conversely, it may cause no tension to be applied at all to the coil at inter-stand portions thereof, with the result of some rolling trouble. To prevent such troubles, drooping characteristic control function is usually incorporated into such control means. "Drooping characteristic control" means so called IR drop being given to automatic speed control means, which any DC motor possesses as its intrinsic characteristic. IR drop is a phenomenon that revolving speed of a motor tends to change downward (or upward) with an increase (or decrease) in a current flowing through an armature.

Where a control function having such characteristic is incorporated in automatic speed control means, if excessive tension is going to be applied to the coil, armature current in the mill motor for the downstream-side stand will increase to slow down the motor speed (while armature current in the mill motor for the upstream-side stand will decrease to raise the motor speed) so that the tension may be moderated. Conversely, if tensionless condition develops, current in the mill-motor for downstream-side will decrease to raise the motor speed (while current in the mill motor for the upstream-side stand will increase to slow down the motor speed) so that tension may be regained. Thus, coil cut-off and rolling trouble may be prevented.

At threading stage, however, the presence of drooping characteristic is rather inconvenient. Current in mill motors is rather small at pre-threading stage at which mill-motor speed setting is made according to the predetermined conditions, but as the top end of a coil is inserted between the rolls, current tends to rapidly increase to lower the motor speed. Therefore, off-gauge is unavoidable, however appropriate the mill-motor speed setting at pre-threading stage may be. Similarly, at acceleration stage next to threading stage, or at deceleration and tail-out stages, off-gauge is likely to develop due to sudden changes in mill motor speed.

OBJECTS OF THE INVENTION

The present invention contemplates to solve above said problems of the prior art. Accordingly, it is an object of the invention to provide a method of controlling the revolving speeds of mill motors in a cold tandem mill so that possible off-gauge occurrence during threading, rolling acceleration, rolling deceleration, and/or tail-out can be prevented and controlled notwithstanding a certain drooping characteristic incorporated in the mill so as to prevent coil cut-off and/or rolling troubles.

It is another object of the invention to provide a method of controlling the revolving speeds of mill motors which permits a high gauge-control accuracy even when inter-stand tension becomes intolerably abnormal.

The above and other related objects and novel features of the invention will be apparent from a reading of the following description of the disclosure found in the accompanying drawings and the novelty thereof pointed out in the appended claims.

DETAILED DESCRIPTION OF THE INVENTION

The invention will now be explained in detail with reference to the drawings and more particularly to FIG. 1 in which is shown by way of example a 5-stand tandem mill employing the method of the invention.

Figure 1:
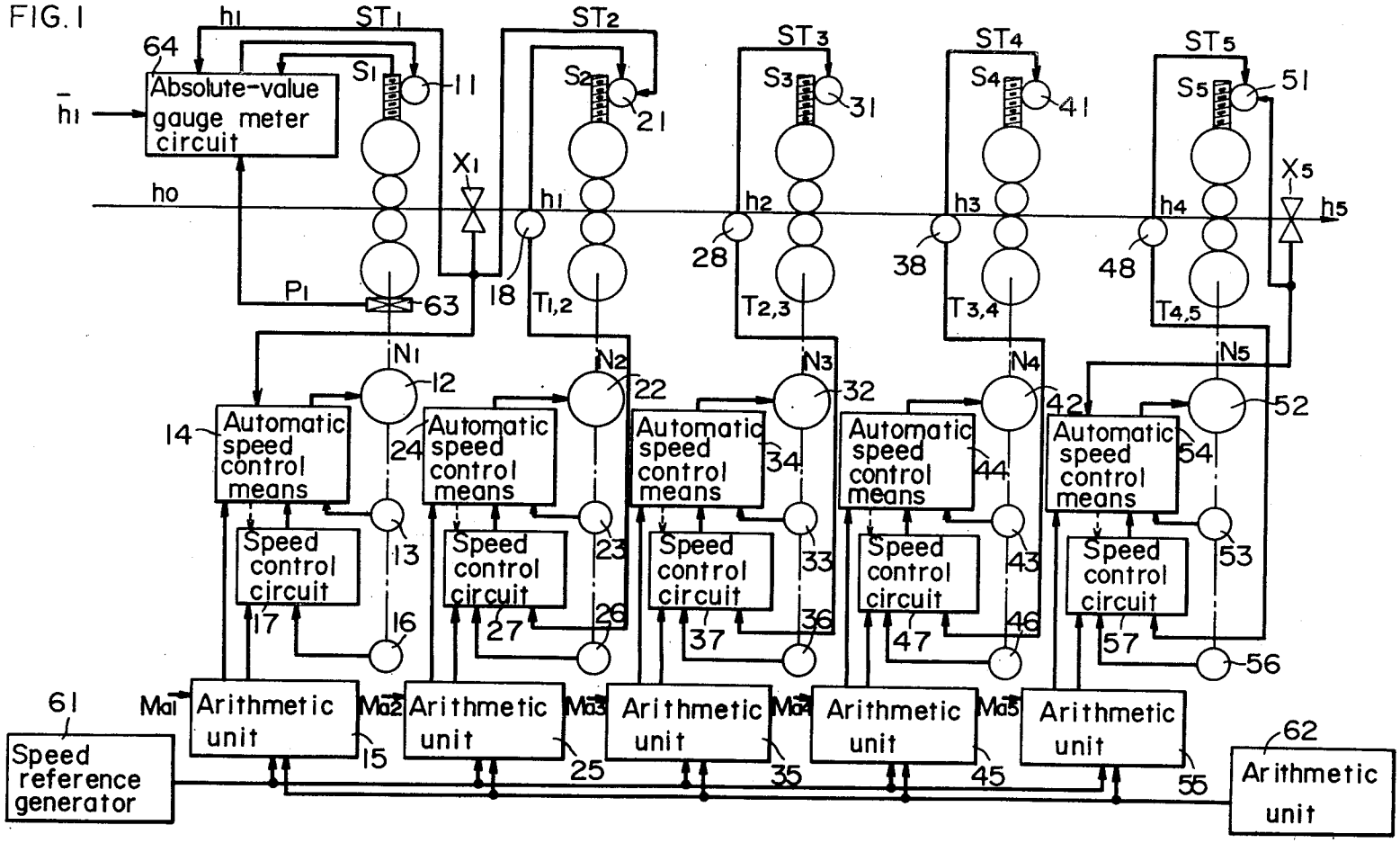
FIG. 1 is a schematic diagram showing a mill-motor revolving speed control system in a cold tandem mill in which the method according to the present invention is employed.

The tandem mill in FIG. 1 has five stands $ST_1$, $ST_2$ . . . $ST_5$, with X-ray thickness gauges $X_1$ and $X_2$ disposed adjacent the first stand $ST_1$ and the fifth stand $ST_5$ on their respective outlet sides. Each stand has a motor-powered screw-down position control. More specifically, the first stand $ST_1$ is provided with thyristor-type screw-down positioning means 11, and the second to fifth stands $ST_2 \sim ST_5$ are provided with motor-generator type screw-down position control systems 21, 31~51 (which may be of thyristor type instead). Mill motors 12, 22~52 for the stands $ST_1 \sim ST_5$ are speed controlled by automatic speed control means 14, 24~54 which act on signals from tachometer generators (analog speed detectors) 13, 23~53.

In the description that follow, the following symbols, wherever used, are understood to have the following meanings respectively;

hi: exit gauge of the ith stand STi (where i=1, 2 . . . 5. Same shall apply hereinafter);

Si: screw-down position at the ith stand STi;

Ti,i+1: inter-stand tension, that is, tension between the ith stand STi and the (i+1)th stand STi+1;

Ni: revolving speed of mill motor at the ith stand STi; and $h_0$: entry gauge of the first stand STi To obtain a cold-rolled steel sheet of the desired gauge from a hot-rolled coil fed to the tandem mill, it is necessary to preset, for each stand, screw-down position Si and mill-motor speed Ni. Values Si and Ni are determined according to the following known equations:

$$Si = hi - (Pi/Mi) - S_0i \quad (1)$$

$$Ni = K/hi(1+fi) \quad (2)$$

Here hi is target value for gauge at the outlet of each stand. For this purpose a gauge schedule is used which may be determined on the basis of $h_0$ and $h_5$ (target value for final gauge) or may be determined independently. Symbol Pi represents rolling force at the ith stand STi, that is, a function determined by said value hi and inter-stand tension Ti,i+1 (for which tension a target value is set as well). Symbol Mi is a factor of mill stiffness for the ith stand STi, $S_0i$ is the zero point of the ith stand STi screw-down position, fi is forward slip ratio at the ith stand STi, and K is a constant.

Setting of screw-down position $S_1$ for the first stand $ST_1$ before threading is carried out manually, and after the top end of the hot-rolled coil is inserted into the first stand $ST_1$, absolute value AGC is actuated. It is noted that any error in screw-down position $S_1$ setting for the first stand may effect gauge hi at the outlet of the stand as well as those at all down stream stands, thus resulting in an error in final gauge $h_5$.

Absolute-value AGC detects screw-down position and rolling force to determine the exit gauge and controls the gauge so as for it to conform to the target value. No precise forcast is required of rolling force, and therefore, any large-scale process control computer need not be employed, provided that zero point $S_{01}$ of screw-down position should be accurately detected. During rolling operation, detection of zero point $S_{01}$ is made by tracing the difference between gaugemeter reading and X-ray thickness gauge $X_1$ indication, which difference is regarded as zero point $S_{01}$. If roll heat-up is a problem after prolonged mill shutdown, zero adjustnent for accurate detection of $S_{01}$ should be made by bringing the upper and lower rolls in contact together while letting them idle.

Setting before threading of screw-down position $S_2 \sim S_5$ for the second to fifth stands is effected manually as is the case with the first stand. Any error in screw-down positions $S_2 \sim S_5$ may have some influence on the backward tension at each respective stand, but little effect on final gauge $h_5$.

As will be explained hereinafter, at threading stage, control is effected so that if inter-stand tension Ti,i+1 deviates from the predetermined tolerance limits (control target range), the screw-down position for each downstream-side stand is adjusted so as to allow the inter-stand tension Ti,i+1 to come within the target range. This is based on the finding that where the revolving speed of mill motors is controlled so as to be translated into target values, deviation of the inter-stand tension from the target value therefor arises from deviation of the screw-down position from the target value therefor.

Now, procedures of mill motor control will be described, first with mode of setting up.

Referring to FIG. 1, numerals 15, 25~55 designate arithmetic units which give references to automatic speed control means 14, 24~54 respectively, and 16, 26~56 designate pulse generators which supply pulses proportional to the respective revolving speeds of mill motors 12, 22~52. Numeral 61 designates speed reference generator for the whole tandem mill. Numeral 62 designates an arithmetic unit which computes speed ratio for each stand.

First of all, gauge schedule hi is set and placed into draft schedule setting unit (not shown). Where draft schedule is set on the basis of $h_0$ and $h_5$ as mentioned above, the draft schedule setting unit is provided with a memory which stores a plurality of gauge schedules relating to representative $h_0$–$h_5$ combinations. Upon receiving $h_0$, $h_5$ inputs, the unit reads from the memory a gauge schedule covering the input $h_0$, $h_5$ combination or a representative $h_0$, $h_5$ combination approximately corresponding thereto, and supplies to the arithmetic unit 62 the so read-out gauge schedule or a gauge schedule computed by approximation from a plurality of read-out gauge schedules as the desired gauge schedule. The arithmetic unit 62 calculates revolving speeds of the mill motors 12, 22~52. For the purpose of this calculation, equation (2) is followed in principle, but actually calculation is made according to the following equation (3), a more detailed expression;

$$Ni=k/(hi\cdot(1+fi)\cdot Rwi\cdot gi) \quad (3)$$

where, $K=k/(Rwi\cdot gi)$

Rwi: roll diameter gi: gear ratio between mill motor for ith stand STi and roll.

Roll diameter Rwi value is set into the arithmetic unit 62 by a setting unit not shown, each time roll change is made with respect to rolls incorporated in the ith stand. Forward slip ratio fi value is anticipatorily computed by the arithmetic unit 62 on the basis of rolling schedule for the ith stand, including such data as entry gauge hi−1, exit gauge hi, sheet width, draft at the first stand, total draft up to the ith stand, and material. For this purpose, a fi table corresponding to such rolling schedule (or more specifically reduction schedule for each stand) is stored in the arithmetic unit so that appropriate value may be calculated by interpolation and/or extrapolation; alternatively, a simple linear function relating to fi and based on the rolling schedule is provided so that fi value may be readily calculated.

The arithmetic unit 62 calculates mill motor speed Ni at each stand in manner as described above, and then calculates mill-motor speed ratio SSRHi for each stand on the basis of the calculated Ni values as against the maximal one thereof. The mill-motor speed ratio thus calculated is communicated to arithmetic units 15, 25~55 for the individual stands.

Speed reference generator 61 is actuated when speed acceleration or deceleration is required with respect to all stands. Its output value or speed reference value is communicated to arithmetic units 15, 25~55 for individual stands, and each of the arithmetic units 15, 25~55 in turn does carry out multiplication of the input value from the speed reference generator 61 and the input value SSRHi from arithmetic unit 62 and communicates the product as a speed reference to the appropriate one of automatic speed control means 14, 24~54, the setup of which will be described in detail hereinafter. The basic function of automatic speed control means 14, 24~54 is to analogically detect revolving speeds of mill motors 12, 22~52 by means of a tachogenerator and to control mill-motor speeds so that they may conform to the speed references received from the arithmetic units 15, 25~55. In FIG. 1, reference character Mai designates a manual control signal given to the arithmetic units 15, 25~55, indicating that manual interference by the operator is possible.

Mill-motor speeds are accurately set before threading operation in manner as above described.

One may consider that in operation according to equation (2) or (3) shown above the forecast accuracy of forward slip ratio fi will more or less affect the accuracy of calculated Ni value. It is noted, however, that absolute value of forward slip is less than 10% in normal rolling operation, and that in either equation, fi is represented in the form of (1+fi); therefore, calculation error in (1+fi) can easily be limited to a few percent or less. Since fi value is obtainable in above described manner without using any large-scale process control computer, the desired accuracy can be obtained in setting of mill-motor speed Ni.

Now, consider the relation between mill-motor speed and gauge. Motor speed must be accurately controlled to the extent that the relation $N_1\cdot h_1(1+f_1)=N_2\cdot h_2(1+f_2)\ldots=N_5\cdot h_5(1+f_5)$ holds; or otherwise, final gauge $h_5$ may not come within the target value range even if value $h_i$ (as measured by X-ray thickness gauge X1 in the examples herein) is so controlled as to conform to the target value. According to this reasoning, now that mill-motor speed Ni is accurately set in manner as above described, said relation holds and, therefore, control accuracy of final gauge $h_5$ should improve. As already noted, however, at threading stage, for example, said relation may often be disturbed by any error caused at the time of insertion of top end, with the result of decreased control accuracy. In the present invention, this problem is solved in manner as described below.

Reference numerals 18, 28, 38 and 48 designate tension gauges provided individually at between-stands locations, i.e., $ST_1$~$ST_2$, $ST_2$~$ST_3$, $ST_3$~$ST_4$, and $ST_4$~$ST_5$, to detect inter-stand tension values $T_{1,2}$, $T_{2,3}$, $T_{3,4}$ and $T_{4,5}$. Detected tension values are given correspondingly to screw-down position control systems 21, 31~51 for stands $ST_2$~$ST_5$, and also to speed control circuits 27, 37~57 for stands $ST_2$~$ST_5$. Output $P_1$ of load cell 63 for sensing rolling force at stand $ST_1$ is supplied to absolute-value gauge meter circuit 64, which also receives such data as screw-down position $S_1$ for stand $ST_1$, stand ST exit gauge $h_1$ from X-ray thickness gauge, and target value $\overline{h_1}$ of stand $ST_1$ exit gauge. On the basis of these input data, the circuit controls screw-down position setting means 11 for stand $ST_1$ so as to make value $h_1$ agree with value $\overline{h_1}$. For feed-forward control, output of X-ray thickness gauge $X_1$ is also supplied to automatic speed control means 14 and further to screw-down position control system 21 for stand $ST_2$. For feed back control, output of X-ray thickness gauge X5 is supplied to motor-generator type screw-down position control system 51 for stand $ST_5$ as well as to automatic speed control means 54. Further, it is so arranged that outputs of pulse generators 16, 26~56 are supplied to speed control circuits 17, 27~57 respectively. Outputs of analog speed sensing means such as tachometers, instead of pulse generators 16, 26~56, may be supplied to speed control circuits 17, 27~57.

Figure 2:
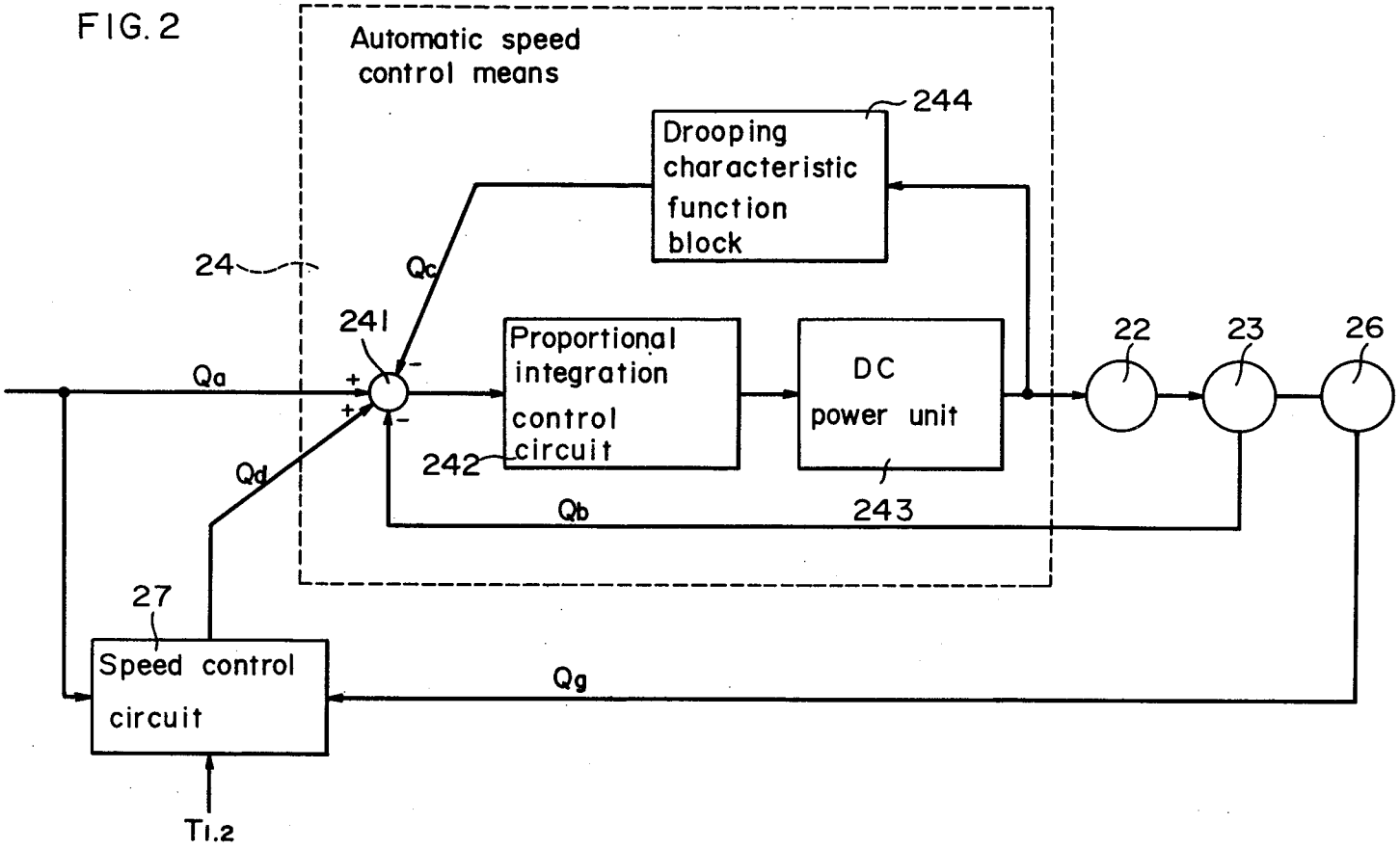
FIG. 2 is a block diagram showing key parts of automatic revolving speed control means 24.

FIG. 2 is a block diagram showing key portions of automatic speed control means 24 and speed control circuit 27. Corresponding control means and circuit for stands other than $ST_2$ are arranged similarly to those in FIG. 2. So, by way of example, description is made of those for stand $ST_2$.

To addition circuit 241 of the control means 241 is given speed reference value Qa as an augend (or minuend) by said arithmetic unit 25 and detected value of speed Qb as a subtrahend by tachogenerator 23 connected to mill motor 22. Data Qa–Qb goes to proportional integration control circuit 242 which controls operation of a DC power unit 243 such as DC generator, the output of which drives mill motor 22. Basically, through this process is control performed of mill-motor speed so that relation $Qa-Qb=0$ may be attained. Further, there is provided a drooping characteristic function block 244 which receives current as control information from the DC power unit 243, that is, the same current as mill motor 22 is supplied with. The output Qc of the block 244 which varies according to the magnitude of the input current value is supplied as a substrahend to the addition circuit 241. In addition, for the purpose of practising the method of the present invention, there is provided a speed control circuit 27 which receives output Qg from pulse generator 26, output $T_{1,2}$ from tension gauge 18, and also speed reference Qa from arithmetic unit 25.

According to the control method of the present invention, the speed control circuit 27 checks inter-stand tension $T_{1,2}$, and if no deviation from the predetermined upper (or lower) tolerance limit is found of the tension value, control signal Qd equalizing Qa with Qg (or in other words, control signal Qd which may cancel drooping characteristic Qc) is given as an augend to the addition circuit 241. After the top end of the coil has been inserted between the rolls of stand STi, if there occurs an increase in motor current, the drooping characteristic of the drooping characteristic function block 244 reacts to the current increase and accordingly the drooping characteristic function block output Qc increases, which is apparently just equivalent to a decrease in Qa value. However accurate the mill-motor speed setting before threading may be, this can happen and might lead to decreased mill-motor speed. However, the speed control circuit 27 provides an output signal Qd of such value as will prevent departure of Qa from Qg due to the increased Qc value (in plain terms, Qd=Qc), thus nullifying the drooping characteristic for the moment. Since input data to the speed control circuit 27 are Qa and Qg values, needless to say, value Qd is determined according to the change in Qg value which decreases in respose to an increment in Qc value, or according to the increment in Qa−Qg value. In short, the speed control circuit 27 performs a control function of reversing the decrease in mill-motor speed due to the drooping characteristic. Said control signal Qd stops if the inter-stand tension begins to depart from the upper or lower tolerance limit. In other words, if the tension exceeds the upper tolerance limit, the speed control circuit 27 does not allow any further change in Qd value in the upward direction of tension. Conversely, if the tension falls below the lower tolerance limit, the circuit does not allow any further Qd change in the downward direction of tension. Needless to say, the control function of the speed control circuit 27 is not limited to that at threading stage. In the event of any inter-stand tension change beyond said upper or lower limit at acceleration or deceleration stage, the circuit 27 does function similarly as well.

Figure 3:
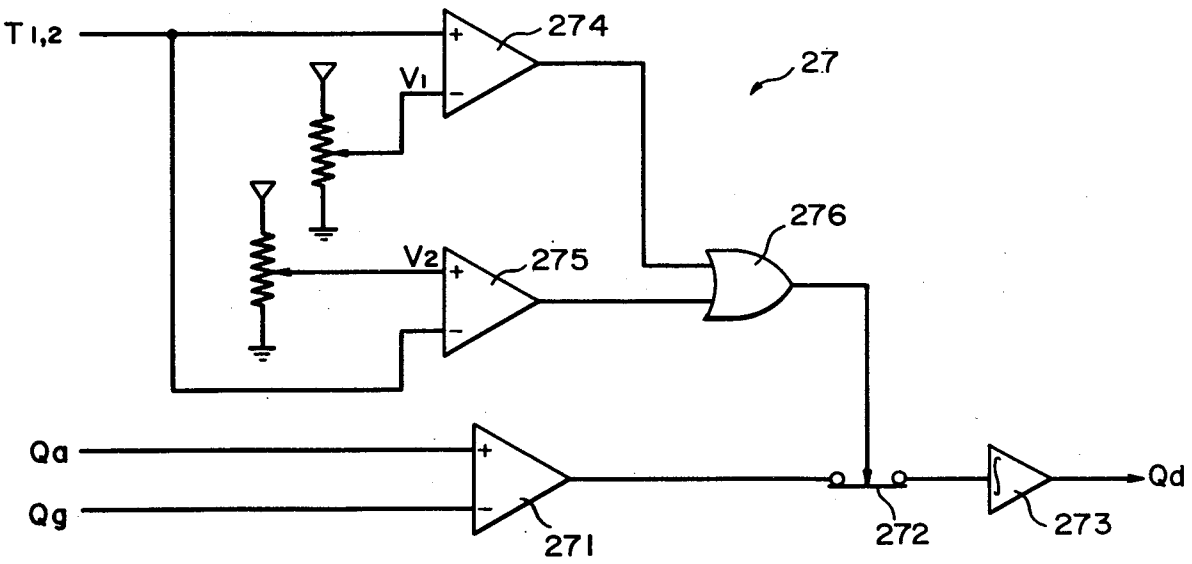
FIG. 3 is a schematic circuit diagram showing a revolving speed control circuit by way of example.

FIG. 3 shows the arrangement of speed control circuit 27. Signals Qa and Qg are received respectively at + and − terminals of a differential amplifier 271, a component of the circuit 27. Signals relating to Qa−Qg from the differential amplifier 271 go to an integration circuit 273 through a normal close-type analog switch 272. The output of the integration circuit 273, as an output signal from the speed control circuit 27, is given to adder 241. Numerals 274, 275 are comparators. Output $T_{1,2}$ of tension gauge 18 is given to + terminal of comparator 274 and also to − terminal of comparator 275. Further, electric potential V1 equivalent to the upper tolerance limit of the tension between stands $ST_1$ and $ST_2$ is given to − terminal of comparator 274; and potential $V_2$ equivalent to the lower limit of the tension between $ST_1$ and $ST_2$ in given to + terminal of comparator 275. Outputs of the both comparators are given as switch signals to analog switch 272 through OR gate 276. If tension gauge output $T_{1,2}$ is greater than $V_1$ or smaller than $V_2$, the outputs of comparators 274, 275 become high enough to open analog switch 272 so that supply of input to the integration circuit 273 is discontinued while the comparator outputs remain high, thus Qd value being prevented from changing.

It is possible to employ a digital circuit instead of such analog circuit as above described for the purpose of the speed control circuit 27. Where an analog circuit of the above described type is employed, it is needless to say that means for digital/analog conversion of output Qg of the pulse generator 26 are required. As already mentioned, it is also possible to employ such arrangement that output Qb of tachogenerator 23, instead of Qg, is supplied to the speed control circuit 27. In such case, it is desirable to use a tachogenerator of such type as is less liable to error.

Figure 4:
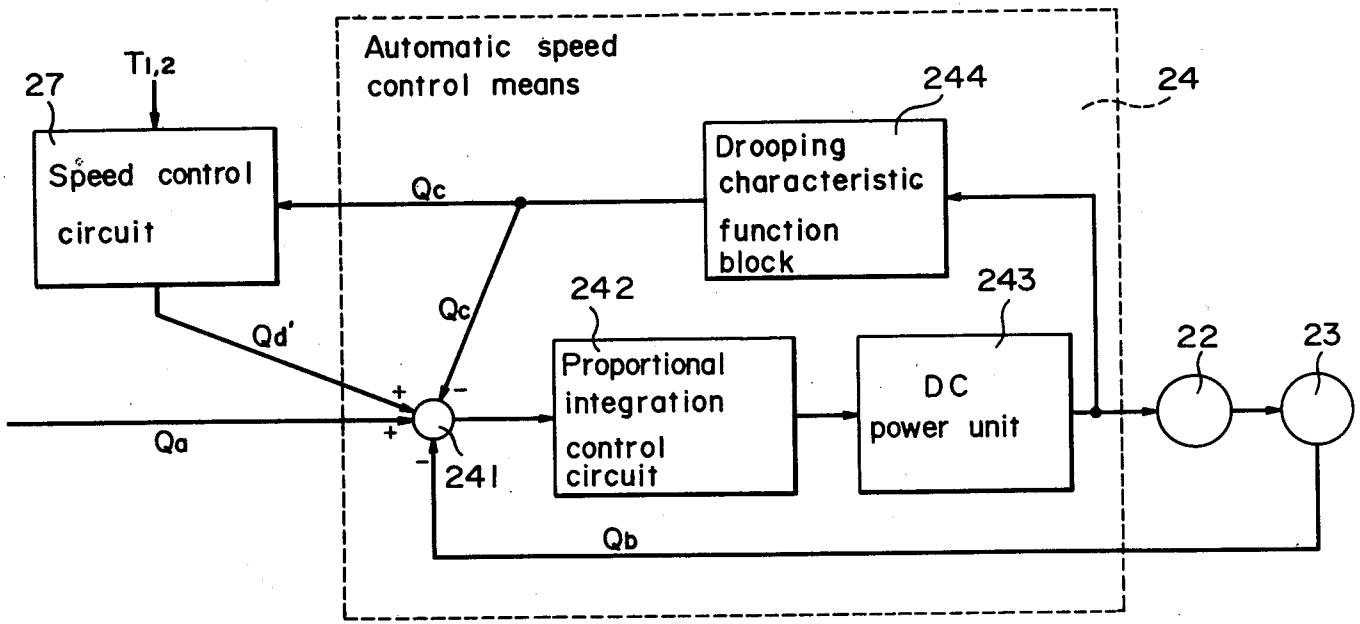
FIG. 4 is a block diagram showing another combination of automatic revolving speed control means and a revolving speed control circuit.

FIG. 4 shows another from of speed control circuit 27 for stand ST2, which arrangement is of course equally applicable to corresponding circuits 17, 27~57 for the other stands. In this form of circuit arrangement, input data to the circuit 27 are output Qc from the drooping characteristic function block 244 and inter-stand tension $T_{1,2}$. On the basis of Qc value (that is, after detecting from the Qc value a decrease in mill-motor speed due to the drooping characteristic, to correct such situation), the speed control circuit 27 sends control signal Qd' to the addition circuit 241 of the automatic speed control means 24. As is the case with the arrangement shown in FIG. 3, signal Qd' is given only when there is no deviation of inter-stand tension from the tolerance limits.

According to the present invention, as above explained, control through the drooping characteristic is performed only when the inter-stand tension departs from the tolerance limits, such motor speed changes caused by the drooping characteristic being corrected when the inter-stand tension stays within the tolerance limits. Therefore, off-gauge occurrences due to sudden motor speed changes at the threading stage caused by the drooping characteristic can be eliminated.

Whilst, by controlling mill-motor speed so that the drooping characteristic function is actuated when inter-stand tension deviates from the tolerance limits, it is possible to prevent such troubles as coil cut-off and the like, but from the standpoint of gauge control, that alone is not sufficient. So, as stated earlier, screw-down position adjustment should be made in the event of the inter-stand tension deviating from the upper or lower tolerance limit. When the tension exceeds the upper tolerance limit, a screw-down motor is caused to revolve for a certain period of time so as to lower the screw-down position of the downstream-side stand. Conversely, when the tension falls below the lower tolerance limit, the screw-down motor is driven for a certain period so as to raise the screw-down position of the upstream-side stand. Where the above described speed setting method is employed, usual tension disorder is attributable to an error in screw-down position setting; therefore, such tension disorder can be effectively remedied by this screw-down position control.

The control system employed for the purpose of screwdown position control is of such arrangement that level identification is made of detected tension signals $T_{1,2}$ received from tension gauge 18, for example, and on the basis of the results thereof a motor for screwdown position adjustment is actuated.

Figure 5:
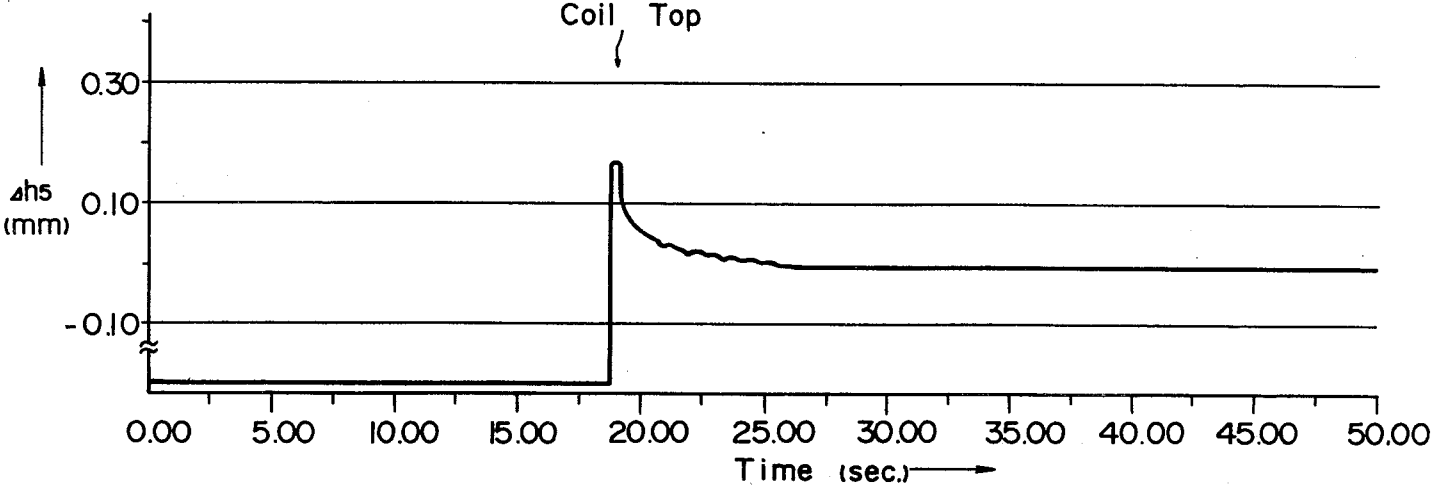
FIG. 5 is a graphical representation showing measurements of gauge deviation from target of coil head portion during threading operation where the method according to the invention is employed.

Presented in FIG. 5 is a graph showing measurements by X-ray thickness gauge $X_5$ of the mill-outlet side gauge $h_5$ with respect to the head or top end portion of a coil where threading is carried out according to the method of this invention. The rolling conditions employed are as shown in Table 1.

As is apparent from FIG. 5, according to the present invention, it is possible to reduce off-gauge in the head portion of the coil to less than 10 m as against about 50 m, an off-gauge level usual with conventional method, thus considerable improvement being obtained in yield.

TABLE 1

| Stand No. | Inlet side | ST1 | ST2 | ST3 | ST4 | ST5 |
|---|---|---|---|---|---|---|
| Outlet-side gauge (mm) | 23 | 1.50 | 1.06 | 0.733 | 0.436 | 0.270 |
| Tension stress (kg/mm$^2$) | 0 | 13.4 | 17.0 | 13.0 | 19.5 | 5.8 |
| Total tension (ton) | 0 | 19.0 | 17.0 | 9.0 | 8.0 | 1.47 |
| Rolling force (ton) | — | 987 | 874 | 575 | 657 | 738 |
| Rolling torque (kg-m) | — | 5030 | 6764 | 7836 | 6350 | 5812 |
| Speed setting (m/min.) | — | 36 | 52 | 76 | 123 | 200 |

The above described method is such that signals offsetting output signals of the drooping characteristic block are given by speed control circuits 27 . . . so that drooping characteristic action is not effected during threading and certain other phases of operation. Unlike this mode of control, another invention under the present application contemplates to accomplish effective gauge control without nullifying the drooping characteristic.

In the process of their research endeavor for a solution to the problem of gauge variation resulting from changes in mill-motor speed due to such drooping characteristic, the present inventors had the following observation. That is, when the top end of a coil remains unthreaded, armature current in the mill motor for each stand is zero or at a value very close to zero, but as the top end of the coil is inserted between the rolls, the amount of driving current increases and the revolving speeds of mill motors decrease because of the drooping characteristic of the motors, which the result of such gauge variation as above described. This is attributable to the fact that the inter-stand ratios of mill-motor speeds that have been set prior to threading are decreased under the influence of the drooping characteristic excited by the threading-up of the coil head, independently of said set speeds. This observation led to the conclusion that a solution to the problem of such gauge variation is to arrange so that the ratio of downward motor-speed change to the preset motor speed may be substantially same among all the individual stands, whereby inter-stand speed ratios after the insertion of coil head into the rolling mechanism may be kept same with those of preset speeds, thus gauge variation being prevented. More specifically, it is possible to effectively control gauge variation due to drooping characteristic of mill motors by adjusting and controlling the decrease in speed due to the drooping characteristic of the mill motor in a stand at which the head of the coil being threaded so that the ratio between the decrease in speed due to the drooping characteristic of the mill motor in a stand into which the coil head has just been threaded and the speed set for or actual speed of the mill motor, and the ratio between the decrease in speed due to the drooping characteristic of the mill motor in a stand at which the coil head is being threaded and the speed set for or actual speed of the mill motor may be kept constant or equal to the predetermined reference values.

Figure 6:
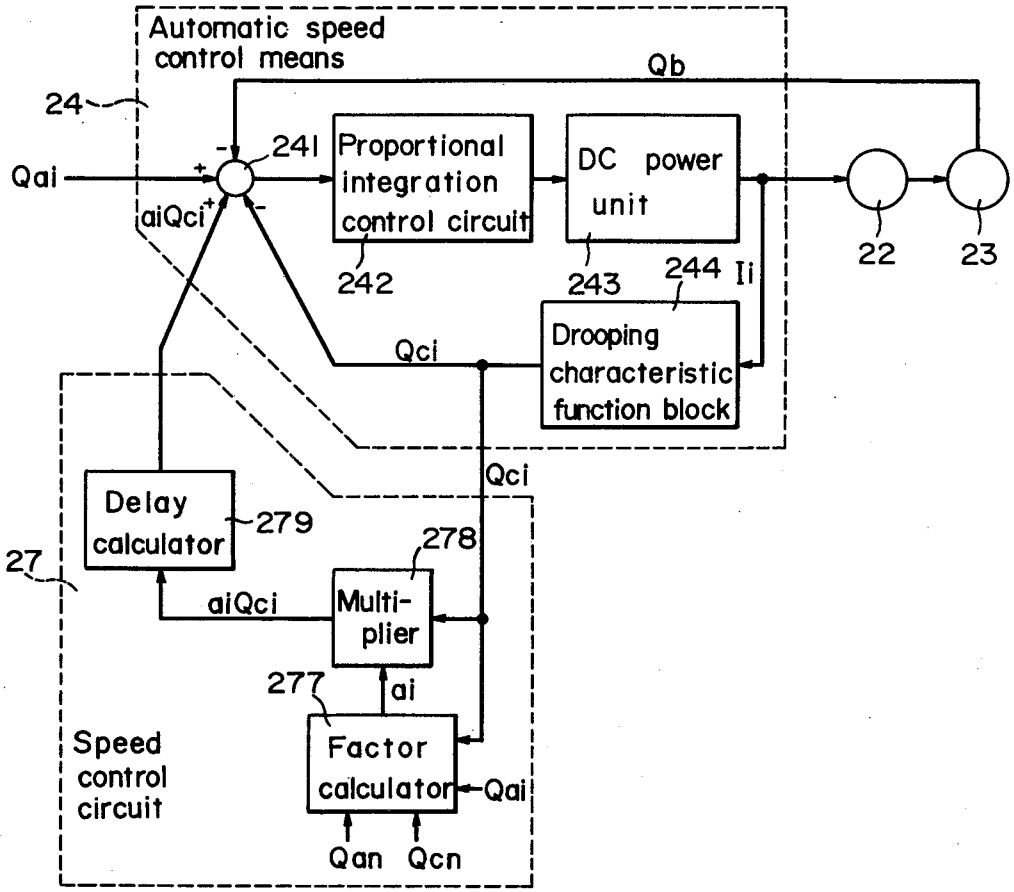
FIG. 6 is a block diagram showing another form of revolving speed control means.

The method is described in further detail hereinbelow. FIG. 6 is a block diagram showing the setup of automatic speed control means 24 and a speed control circuit 27 in accordance with the method.

The arrangement of automatic speed control means 24 is same as that shown in FIGS. 2 and 4. Here too, description is made of the arrangement for stand ST2 by way of example as in the preceding description. The speed control means 24 comprise addition circuit 241, proportional integration control circuit 242, DC power unit 243, drooping characteristic function block 244 and so on.

The drooping characteristic function block 244 will now be explained in detail. It is an analog circuit which computes speed drop value Qci from output current of the DC power unit 243 or drive current Ii in mill motor 22 (here, i=2, same applicable hereinafter) and feeds same as output. This computation is made according to the following equation;

$$Qci = Ii \times \left( \frac{Zi \cdot Vmax\ i}{Ibi} \right) \tag{4}$$

where,

Ibi: base current as calculation basis (mill-motor rated current)

Vmax i: rated maximum rolling speed (Sometimes, base rolling speed may be used)

Zi: droop ratio.

The addition circuit 241 receives speed reference value Qai(+), speed detection value Qbi(−) from tachogenerator 23, and said speed drop value Qci(−); it also receives from speed control means 27 value ai Qci which will be described hereinafter.

The speed control means 27 comprises a factor calculator 277, a multiplier 278, and a delay calculator 279.

The factor calculator 277 receives said speed drop value Qci, speed reference value Qai for the stand ($ST_2$ in the present example), speed reference value Qan for the nth stand as a base value, and speed drop value for the nth stand as a base value. The factor calculator 277 calculates correction factor ai on the basis of these inputs. The multiplier 278 calculates ai Qci, and the product is fed as an augend to an adder through the delay calculator 279. Through this process, a speed drop value is corrected: $Qci - aiQ = (1 - \mathbf{ai})Qci$.

As already mentioned, control is made so that the ratio of speed drop value to speed reference value is same for all the stands. Therefore, ai must satisfy the following equation.

$$\frac{Qcn}{Qan} = (1 - ai)\frac{Qci}{Qai} \tag{5}$$

So, the factor calculator 277 is adapted to carry out operation according to the following equation.

$$ai = 1 - \frac{Qcn \cdot Qa}{Qan \cdot Qc} \quad (6)$$

Any stand may be taken as base or reference stand, but normally base stand is the first stand $ST_1$ into which the top coil end is threaded earlier than all other stands.

In FIG. 6, $Qai = Qbi + (1 - ai)Qci$ (at the nth stand, however, the expression is written: $Qan = Obn + Qcn$); therefore, by substituting same into equation (6) and expanding, equation (7) is obtained.

$$ai = 1 - \frac{Qcn\{Qbi + (1 - ai)Qci\}}{(Qbn + Qcn)Qci} \quad (7)$$

$$ai\,(Qbn + Qcn)Qci = Qbn \cdot Qci - Qcn \cdot Qbi + aiQcn \cdot Qci$$

$$ai = \frac{Qbn \cdot Qci - Qcn \cdot Qbi}{Qbn \cdot Qci} = 1 - \frac{Qcn \cdot Qbi}{Qbn \cdot Qci}$$

That is, use of actual speed value in place of speed reference value may bring the speed ratio in alignment with the target value.

Therefore, ai may be obtained by using Qbi and Obn in place of Qai and Qan respectively and according to said equation (7).

Value ai thus obtained is fed to multiplier 278, which then works out aiQc and sends it to addition circuit 241 through delay calculator 279. The delay calculator 279, which has a first order delay element or similar delay element, is adapted to pass the input from the multiplier 278 to the adder 241 with comparative slowness. There are two reasons why the delay calculator 279 is incorporated in the setup. One reason is that if there occurs a sudden change in mill motor speed which may result in the coil being subjected to excessive tension or conversely placed in tensionless state, drooping characteristic control is required to function so as to prevent such possible undesirable development; however, if the output of the multiplier 278 is applied to the addition circuit 241 without any time delay, the effect of the drooping characteristic control is diminished (in the case of ai = 1, drooping characteristic control does not take place) and troubles such as coil cut may result. The delay calculator 279 delays feed of its oiutput aiQc to the adder 241, whereby drooping characteristic is made available only for the period of such delay so that the excessive or too little tension is instantly eliminated, whereupon value aiQc is allowed to enter the adder 241, thus mill-motor speed ratios being aligned to that for the reference stand.

Another reason is that it has empirically become apparent that allowing such delay renders it possible to prevent the top end portion of the coil to bend upward or downward (instead of passing along the center level line of the mill) at the threading stage. Since such delay element is unnecessary after completion of threading, the delay element may be allowed to cease as rolling operation enters acceleration stage.

In the example shown in FIG. 6, the ratio between the speed reference value (or actual speed value) and speed drop value at the nth stand or usually the first stand is taken as reference ratio with which such ratio at another stand should agree. Alternatively, such ratio for all stands including the first stand may be made agree with a suitably predetermined ratio. The speed control means 27 may be of digital arrangement instead of analog one as shown. In that case it is necessary to use averaged data based on a plurality of sample values for the purpose of ai value computation, in order to improve noise resistance. With regard to ai conversion, all calculated ratios need not be exactly same. Presence of a less than 1% insensible zone may be considered natural.

Figure 7:
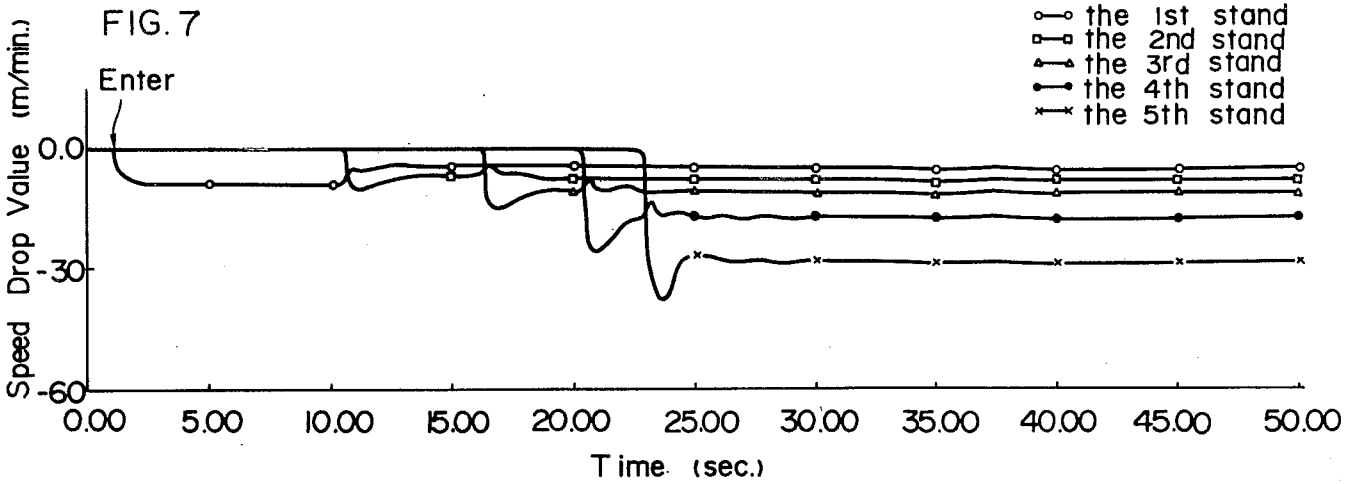
FIG. 7 is a graphical representation showing changes with time in the quantity of mill-motor speed drop before and after threading-up of coil where the method of the invention is employed.
Figure 8:
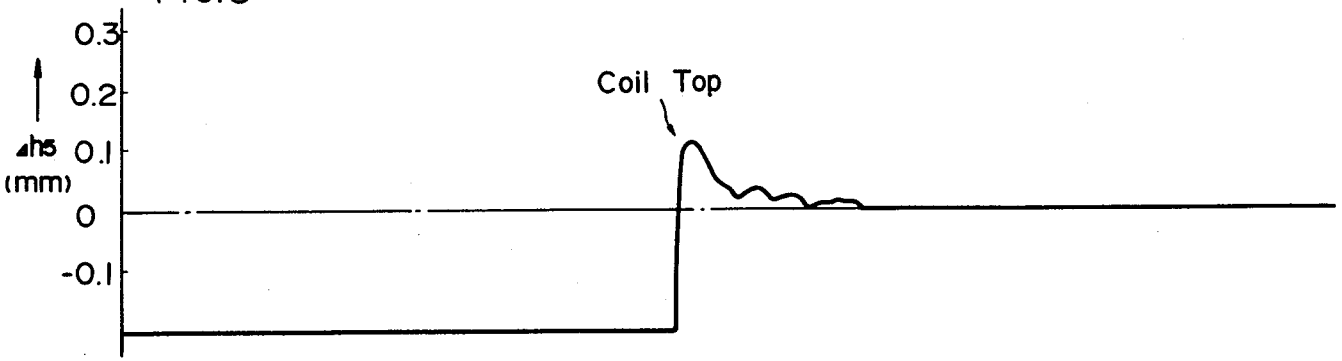
FIG. 8 is a graph showing measurements of gauge deviation from target of coil head portion during threading-up where the method of the invention is employed.

FIG. 7 shows changes with time in the quantities of mill-motor speed drop (cm/min.) at individual stands before and after coil threading, where the method of the present invention. FIG. 8 shows actual measurements by X-ray thickness gauge $X_5$ of gauge deviation $\alpha h_5$ at the outlet of the fifth stand $ST_5$, where the method is employed. Rolling conditions are same as those shown in Table 1. Conditions not shown therein, such as maximum rolling speed Vmax i and base torque, are as per Table 2. Droop ratio Zi = 50.

TABLE 2

| Stand | ST1 | ST2 | ST3 | ST4 | ST5 |
|---|---|---|---|---|---|
| Maximum rolling speed (m/min.) | 471 | 620 | 954 | 1,311 | 1,793 |
| Base torque (kg-m) | 23,370 | 25,090 | 17,450 | 15,160 | 11,080 |

Figure 9:
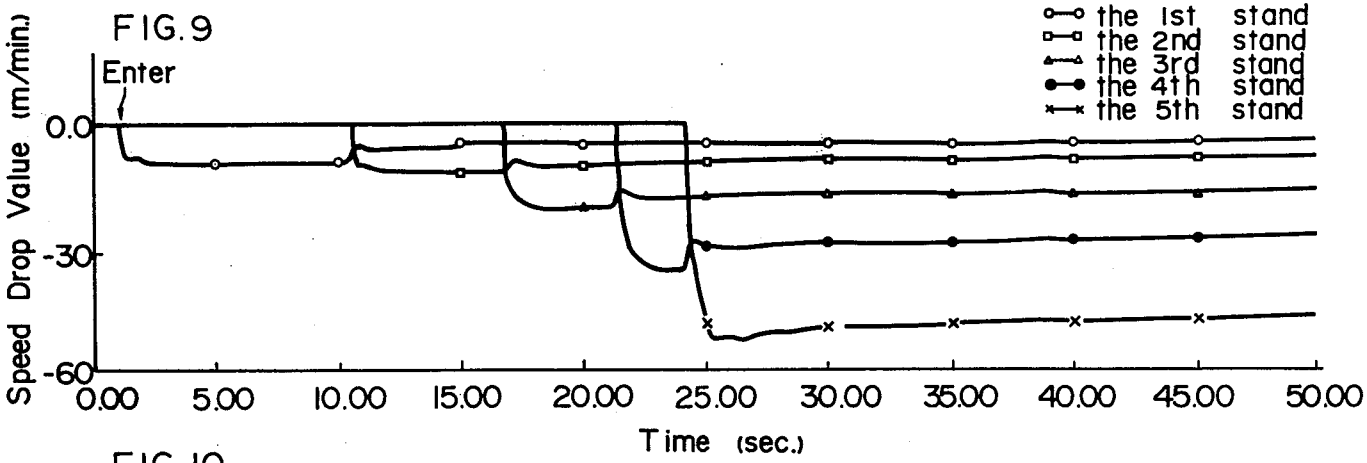
FIG. 9 is a graph showing changes with time in the quantity of mill-motor speed drop before and after threading-up of coil, where the method of the invention is not employed.
Figure 10:
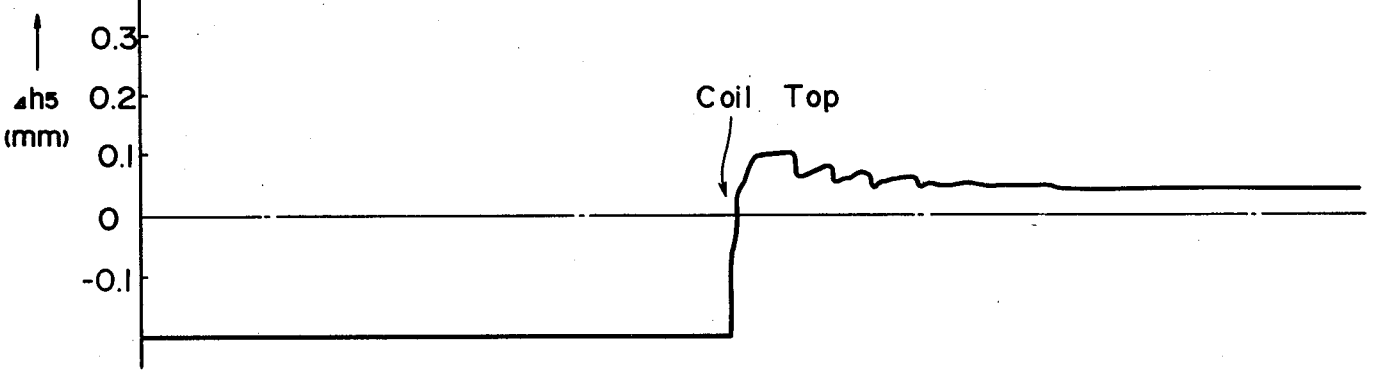
FIG. 10 is a graph showing measurements of gauge deviation from target of coil head portion during coil threading-up where the method of the invention is not employed.

FIG. 9 shows changes with time in the quantities of mill-motor speed drop (m/min.) at the individual stands before and after threading-up of coil, where the method of the invention. FIG. 10 gives actual measurements of gauge deviation $\Delta h_5$ at the outlet of the fifth stand, where the method of the invention. Rolling conditions are same as in FIGS. 7 and 8. As can be clearly seen from FIGS. 7~10 graphs, where the method of the present invention is employed, gauge deviation occurrence is reduced to zero 7~8 seconds after completion of threading, with off-gauge length limited to about 8 m, whereas in the case of the claimed method being not employed, gauge deviation is not eliminated even after the completion of threading, with continued deviation from the tolerance limits (±30 μm) over a length of more than 50 m. In the light of this comparison, it can be said that the invention has a very significant effect in solving the problem of off-gauge.

Needless to say, the method of the present invention can be applied to a cold tandem mill equipped with a process control computer and adapted for screw-down position and mill-motor speed setting for individual stands.

It should also be understood that the foregoing relates to only a preferred embodiment of the invention, and that it is intended to cover all changes and modifications of the example of the invention herein chosen for the purposes of the disclosure, which do not constitute departures from the spirit and scope of the invention.

What is claimed is:

1. A method for controlling the revolving speed of a mill motor which drives a stand of rollers in a cold tandem mill, comprising the steps of:

producing a speed control signal to drive said motor at a predetermined reference speed;

generating a drooping characteristic control signal which modifies said speed control signal to produce a decrease in motor speed in response to an increase in motor current;

monitoring the inter-stand tension of the strip being rolled and comparing the detected tension to predetermined limits;

generating a correction signal to compensate the effects of said drooping characteristic control signal on motor speed when the detected tension is within said limits; and enabling said drooping characteristic control signal to modify said speed control signal without compensation when the detected tension is outside said limits.

2. The method of claim 1 wherein said correction signal is dependent on the values of said reference speed and the actual speed of the motor.

3. The method of claim 2 wherein said correction signal is dependent on said drooping characteristic control signal.

4. The method of claim 1 comprising the further step of adjusting screw-down positions of the mill rollers when the detected value of the inter-stand tension is not within said predetermined limits to restore the inter-stand tension to a value within said predetermined limits.

5. The method of claim 4 wherein said correction signal is dependent on the values of said reference speed and the actual speed of the motor.

6. The method of claim 4 correction wherein said signal is dependent on said drooping characteristic control signal.

* * * * *